United States Patent [19]

Denny

[11] 4,370,937

[45] Feb. 1, 1983

[54] TUFTING MACHINES

[76] Inventor: Jon P. M. Denny, 9 Grange Dr., Emley, Huddersfield, England, HD8 9SF

[21] Appl. No.: 174,665

[22] Filed: Aug. 1, 1980

[30] Foreign Application Priority Data

Aug. 3, 1979 [GB] United Kingdom ..... 7927222

[51] Int. Cl.[3] ..... D05C 15/26

[52] U.S. Cl. ..... 112/79 A

[58] Field of Search ..... 112/79 R, 79 A, 79 F, 112/98, 83, 84, 78

[56] References Cited

U.S. PATENT DOCUMENTS

| | | | |
|---|---|---|---|
| 3,585,948 | 6/1971 | Cobble | 112/79 R |
| 3,650,228 | 3/1972 | Lynch | 112/79 R |
| 3,865,059 | 2/1975 | Jackson | 112/79 R |
| 4,226,196 | 10/1980 | Booth | 112/79 R |

FOREIGN PATENT DOCUMENTS

| | | | |
|---|---|---|---|
| 1174277 | 12/1969 | United Kingdom | 112/79 A |

*Primary Examiner*—H. Hampton Hunter

*Attorney, Agent, or Firm*—Diller, Ramik & Wight

[57] ABSTRACT

A tufting machine having two rows of needles 1,2 which depend from a respective needle bar 3*a*, 3*b* carried by a support member 3. Support member 3 is slidably mounted in a carrier 4 which is vertically reciprocal by a mechanism 5. Yarn is fed from a creel through the needles 1,2 and is engaged by loopers 7,8 where it is held while the needles withdraw from the primary cloth 15.

In order to change the design imparted by the machine there is provided a mechanism for increasing or decreasing the warpwise length of the backing cloth or fabric between the two rows of needles. The mechanism includes a roller 13, which is displaceable in a direction transverse to the axis of the roller, and two retaining bars 11, 12, the fabric passing around the roller and retaining bars to define a loop.

9 Claims, 5 Drawing Figures

Figure 4:
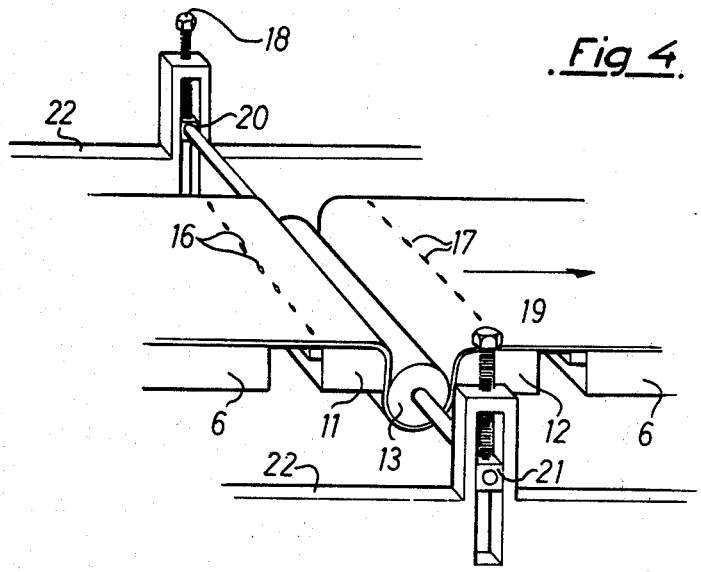

Fig 1.
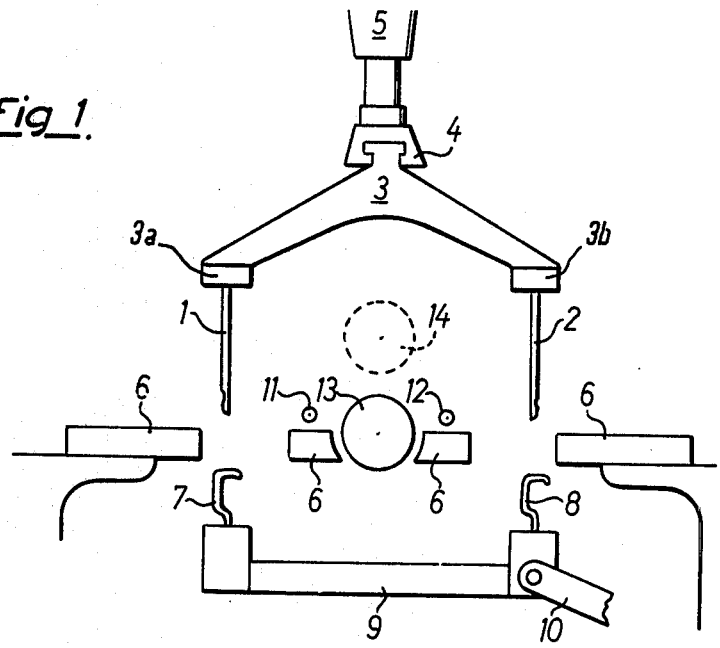
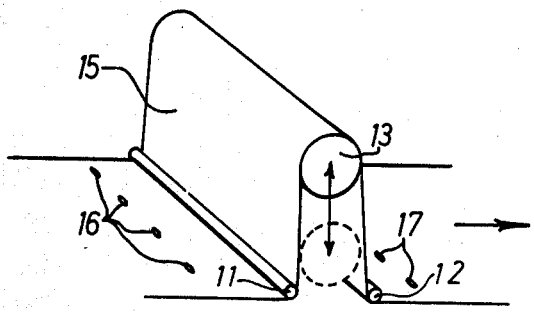
Fig 2.
Fig 3.
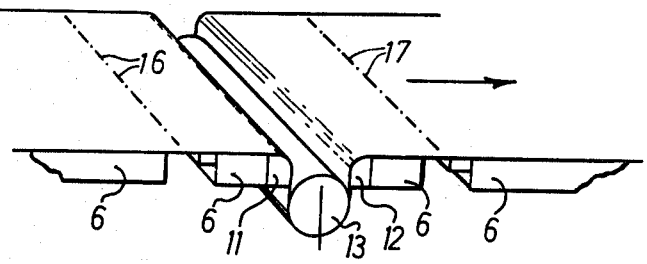

TUFTING MACHINES

This invention concerns tufting machines and relates more particularly to the so-called sliding needle bar tufting machines by means of which, during manufacture, a pattern is incorporated in a tufted textile fabric such as a carpet fabric.

Generally, in a tufting machine, the needles which carry the yarn into the backing fabric are mounted in a needle bar which extends transversely across the machine and in early machines, no pattern was obtainable in the finished carpet other than stripes or bands extending in the warp direction which could be produced by the use of different coloured yarns; or mottled or tweed effects which resulted, for example, if stippled yarns were employed. In later machines, zig-zag lines or bands were produced by introducing relative lateral movement between the backing fabric and the needle bar, a movement which in modern machines is produced by mounting the needle bar to be slidable and by reciprocating the slidable needle bar. Considerable variation in the resulting simple zig-zag patterns may be achieved by using a cam or other actuating device to effect the reciprocating movement, the cam having a profile predetermined to move the needle bar laterally in directions, to extents and at times which are calculated, in co-operation with the various yarns carried by the needles, to produce a required pattern; and such patterns may be still further varied by providing the needle bar with two rows of needles rather than with a single row, the two rows of needles typically being separated from one another in a warpwise direction. However, all patterns produced essentially solely by lateral displacement of the needle bar are of a small geometric nature and even with the employment of two rows of needles on the needle bar the range of sizes of design obtainable in practice are strictly limited.

More recently it has been proposed to use two rows of needles mounted so as to permit adjustment in a warpwise direction of the spacing between the two rows of needles. This results in a considerable increase in the scale of the patterns obtainable and hence the number of variations that may be achieved. However, the facility for warpwise adjustment of the two rows of needles is accompanied by the need for very careful setting up each time a pattern change is made, since all the so-called "gauge parts" (needles, reeds, loopers and knives) must be in close and exact relationship to one another. The setting up process is, of course, time consuming.

In addition to adjustment on the "macro" scale to change the scale of the design, adjustment on the "micro" scale is also desirable in order to square up the design after a change in stitch rate. Changing the stitch rate is the usual method of obtaining the specified weight of pile yarn.

According to the present invention a tufting machine is provided with two needle bars or equivalent members, each carrying a single row of needles, said needle bars or equivalent members being mounted with a space between them in a warpwise direction, and in the space between the needle bars is mounted an adjustable device for increasing or decreasing the warpwise length of primary cloth or backing fabric between the two rows of needles.

By enabling adjustment to be made in the warpwise spacing of the yarn insertions in the backing fabric the invention achieves exactly the same result in terms of providing wider pattern variation potential as the use of two warpwise separated, adjustable needle bars. However, because spacing adjustments can be made without touching the "gauge parts", pattern changes can be made in seconds rather than requiring many hours of painstaking re-setting of multiple small parts.

In a preferred construction, the adjustable device includes a roller around which the primary cloth or backing fabric passes to define a loop therein, the roller being mounted in bearings which are displaceable, in a direction transverse to the roller axis, as by set screws, cam means or other suitable actuating means.

Figure 5:
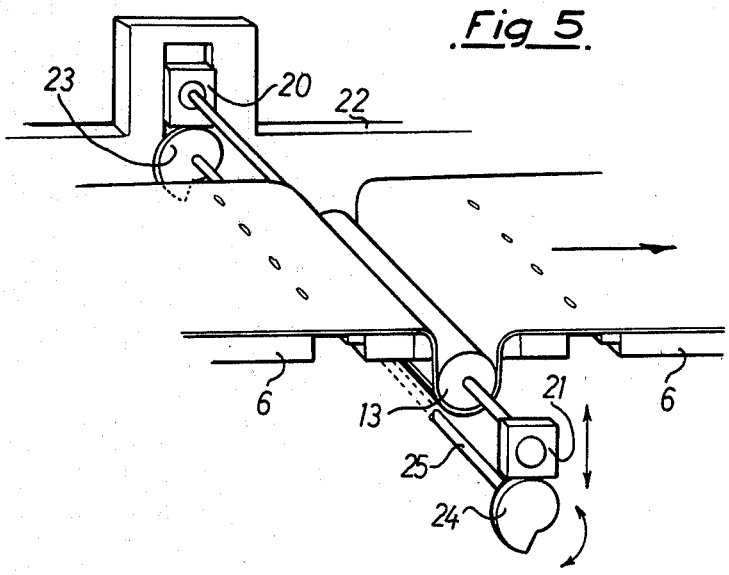

The invention will be described further, by way of example, with reference to the accompanying drawings, in which:

FIG. 1 is a vertical section through the needle bar and looper region of a tufting machine embodying the invention, FIG. 2 is a diagrammatic perspective elevation of a part of the path described by the backing fabric, FIG. 3 is a view similar to that of FIG. 2, showing an alternative roller arrangement, FIG. 4 is a diagrammatic perspective view of a machine embodying a roller arrangement similar to that of FIG. 3 and showing a roller shaft bearing adjusting means, and FIG. 5 is a view similar to FIG. 4, showing an alternative bearing adjusting means.

As shown in FIG. 1 of the drawings, two rows of needles 1, 2 depend from respective needle bars 3*a*, 3*b*, which are carried by a common support member 3, slidably mounted in a carrier 4, which is vertically reciprocable by a mechanism 5 of any convenient conventional construction. Conventional means (not shown) may be provided for effecting lateral displacement of the needle bars 3*a*, 3*b* (that is to say into and out of the plane of the paper as viewed in FIG. 1) responsive to pattern requirements.

The usual reed plates or similar members are illustrated at 6. Yarn (not shown) fed from a creel through conventional guide and jerker bar arrangements through the needles 1, 2 is taken by them to positions below the reed plates 6 at which the yarn is engaged by loopers 7,8. The loopers are mounted on a bar 9 to which an appropriate looping movement is imparted through a linkage 10. For cut pile cloth, knives (not shown) can be fitted to act on the loopers in any convenient conventional manner.

A mechanism for increasing or decreasing the path of the primary fabric is illustrated and in this example it consists of, preferably, a roller 13 which may be pinned or fluted or otherwise enabled to guide or track the backing fabric 15, and two retaining bars or rollers 11,12. The roller 13 is journalled in bearings 20,21 (FIG. 4) at opposite sides of the machine and the bearings are slidable in guides in the main frame 22 on the machine, adjustment to raise or lower the roller to any required position being by way of adjusting screws 18,19.

In theory the length of cloth between the two rows of needles can be held constant and subdivided with the cam or shifting device programme. This is simple with a length of cloth between needles of, say, 24 stitches and shifting device programmes of 2, 3, 4, 6, 8 or 12 stitches. Further extension is also possible by programming the shifting device to give two pattern repeats in three times the row separation, (in the example above a 36 stitch repeat) and so on.

In practise, other factors, such as edge trim waste and primary cloth control make it desirable to work with as small a cloth length between the rows of needles as possible. As an example, a separation of 29 stitches with the facility to adjust up to ±5 stitches each way, will cover most of the practical range of designs.

For calculation purposes the length of a stitch is taken as being equivalent to the guage of the machine although this is an adjustable factor. Thus a length of cloth between rows of needles equivalent to 29 stitches represents 2.9 inches on a 1/10th guage machine and 4.531 inches on a 5/32nd guage machine. The ±5 stitch adjustment being equivalent to ±0.5 inch and ±0.781 inch respectively. Thus the amount of movement required of the pinned roller (13/14 in FIG. 1) is around ±0.25 inch on a 1/10th guage machine and around ±0.4 inch on a 5/32nd guage machine.

FIG. 2 is a diagrammatic view of the backing fabric 15 showing how it is fed under the retaining bar 11, over the pinned roller 13 and under the second retaining bar 12. The needles penetrate the backing fabric on either side of the retaining bars in the approximate positions illustrated by the chain-dotted lines 16, 17.

By way of example, FIG. 3 shows a diagrammatic view of another alternative, in which the retaining bars 11 and 12, are incorporated into the reed plates 6 and the backing fabric is fed under the pinned roller 13.

The method shown in FIGS. 1 to 3 of increasing or decreasing the warpwise length of backing fabric between the two rows of needles is purely for the purpose of illustration; other alternatives may be used to suit specific layout or engineering requirements.

FIG. 5 shows an alternative construction where the roller 13 is moved up or down by the action of two rotatable eccentric cams 23, 24 mounted on a shaft 25 and acting on the bearing housing 20,21, the whole assembly being located on the main frame 22 at both sides (one side only is shown in FIG. 5).

If desired, the pinned roller 13 may be replaced by special rollers of fluted spiral or other design commonly used in textile applications to ensure that fabrics do not wander or crease. Alternatively, the roller 13 can be adjustable though non-rotatable thus constituting effectively a non-rotating bar.

The provision of an adjustable means 13 for increasing or decreasing the distance between the points of penetration 16,17 of the yarn from two warpwise separated needle bars into a backing fabric 15 enables pattern variations to be achieved, which are not otherwise possible with a fixed spacing of the rows of needles. Similar variations may be obtained when the spacing between the rows of needles is adjustable but the present invention obviates the need for extensive lost time when such spacing is changed.

Whilst the invention has been described more particularly with reference to a machine in which the rows of needles are moved together, it is also applicable to machines in which the rows of needles are capable of being moved independently.

I claim:

1. A tufting machine for operating on an elongate workpiece web displaced lengthwise through the machine, comprising a pair of needle bars, a respective row of needles carried by each needle bar, means mounting said two rows of needles transversely in relation to the direction of workpiece movement with a space between the two rows in said direction of movement, a device mounted in said space between the two rows of needles and adapted to engage the workpiece web and means for adjusting said device to enable the length of said workpiece web disposed between the two rows of needles to be selectively increased or decreased.

2. A tufting machine according to claim 1, wherein the web-engaging device comprises a roller around which the workpiece web passes to define a loop therein.

3. A tufting machine according to claim 2, including bearings carrying said roller and set screws to displace the roller in a direction transverse to the roller axis.

4. A tufting machine according to claim 2, including bearings carrying said roller and cam means to displace said bearing and said roller carried thereby to increase the length of the workpiece web between the two rows of needles.

5. A tufting machine for operating on an elongate workpiece web displaceable lengthwise through the machine, comprising a pair of needle bars, a respective row of needles carried by each needle bar, means slidably mounting said two rows of needles for movement in a direction transverse to the lengthwise direction of the workpiece web, a roller adapted to engage said workpiece web, and means adjustably mounting said roller in a space between the said two rows of needles to permit the length of workpiece between the needles to be increased or decreased.

6. A tufting machine as claimed in claim 4 or 5 including two retaining bars, which are aligned in parallel with the axis of the roller and which are mounted on opposite sides of the roller in the lengthwise direction.

7. A tufting machine according to claim 1 or claim 5, further comprising reed plates and retaining bars, means mounting said reed plates on opposite sides of the web-engaging device and said reed plates incorporating said retaining bars, the workpiece passing around said retaining bars and said web-engaging device to define a loop in the workpiece.

8. A tufting machine for operating on an elongate workpiece web displaceable lengthwise through the machine, comprising a frame, a pair of needle bars, a respective row of needles mounted on each needle bar with a space between the two rows of needles in the lengthwise direction, means displaceably mounting said needle bar in said frame, means adjustably mounting bearings in said frame and a roller carried by said bearings, and two retaining bars mounted in the frame on opposite sides of the roller in the lengthwise direction and around which the workpiece web passes to define a loop whose length is selectably adjustable.

9. A tufting machine for operating on an elongate workpiece web displaceable lengthwise through the machine, comprising a pair of needle bars, a respective row of needles carried by each needle bar, means mounting said two rows of needles transversely in relation to the direction of workpiece movement with a space between the two rows in said direction of movement, a non-rotatable bar in said space between the two rows of needles and adapted to engage the workpiece web, and means adjustably mounting said non-rotatable bar to adjust selectively the warpwise length of said workpiece web disposed between the two rows of needles.

* * * * *

UNITED STATES PATENT AND TRADEMARK OFFICE

CERTIFICATE OF CORRECTION

PATENT NO. : 4,370,937

DATED : February 1, 1983

INVENTOR(S) : Jon P.M. Denny

It is certified that error appears in the above-identified patent and that said Letters Patent are hereby corrected as shown below: On the title page Insert:

---[73] Assignee: FIRTH CARPETS LIMITED
West Yorkshire, England---

Signed and Sealed this

Twenty-ninth Day of March 1983

[SEAL]

*Attest:*

GERALD J. MOSSINGHOFF

*Attesting Officer*

*Commissioner of Patents and Trademarks*